US005387123A

United States Patent [19]

Puerner

[11] Patent Number: 5,387,123

[45] Date of Patent: Feb. 7, 1995

[54] PROTECTIVE COVER FOR HEADER

[75] Inventor: Dean A. Puerner, Maracopa, Ariz.

[73] Assignee: The Whitaker Corporation, Wilmington, Del.

[21] Appl. No.: 254,452

[22] Filed: Jun. 6, 1994

Related U.S. Application Data

[63] Continuation of Ser. No. 83,407, Jun. 25, 1993, abandoned.

[51] Int. Cl.[6] ..... H01R 13/53

[52] U.S. Cl. ..... 439/460; 439/186

[58] Field of Search ..... 439/460, 492–499, 439/181, 186

[56] References Cited

U.S. PATENT DOCUMENTS

| | | | |
|---|---|---|---|
| 3,601,768 | 8/1971 | Lightner | 439/459 |
| 4,475,786 | 10/1984 | Root et al. | 439/404 |
| 4,655,525 | 4/1987 | Hunt, III et al. | 439/599 |
| 4,787,864 | 11/1988 | Hunt, III et al. | 439/595 |
| 4,921,442 | 5/1990 | Puerner | 439/499 |
| 5,059,138 | 10/1991 | Olsson | 439/460 |
| 5,080,604 | 1/1992 | Rider et al. | 439/357 |
| 5,114,362 | 5/1992 | Olsson | 439/499 |
| 5,131,864 | 7/1992 | Van Zeelst | 439/460 |

*Primary Examiner*—Gary F. Paumen

[57] ABSTRACT

A cable connector 10 for high voltage which includes a housing 11 and a protective rear cover 12. The protective rear cover 12 is inserted into the housing 11. The protective rear cover 12 has latching projections 23 formed thereon and the housing 11 has latch apertures 17 to receive the latching means. In a preferred embodiment, the latching projections 23 are formed on arms 21, 22 having flange portions that extend sidewardly and forwardly from the latching projections 23. The arms 21, 22 are received inside the housing 11 adjacent to the latch apertures 17 and cover any spaces of the housing wall latch apertures 17 not filled by the latching projections 23 to prevent arcing through the apertures 17. In another preferred embodiment, a sleeve-like member 34 is disposed over the cable receiving face 13 of the housing 11. The sleeve-like member 34 covers the latch apertures 17 and prevents arcing.

5 Claims, 8 Drawing Sheets

20
12
23
23
22
25
25
11
13
15
17
17
18

Fig. 5
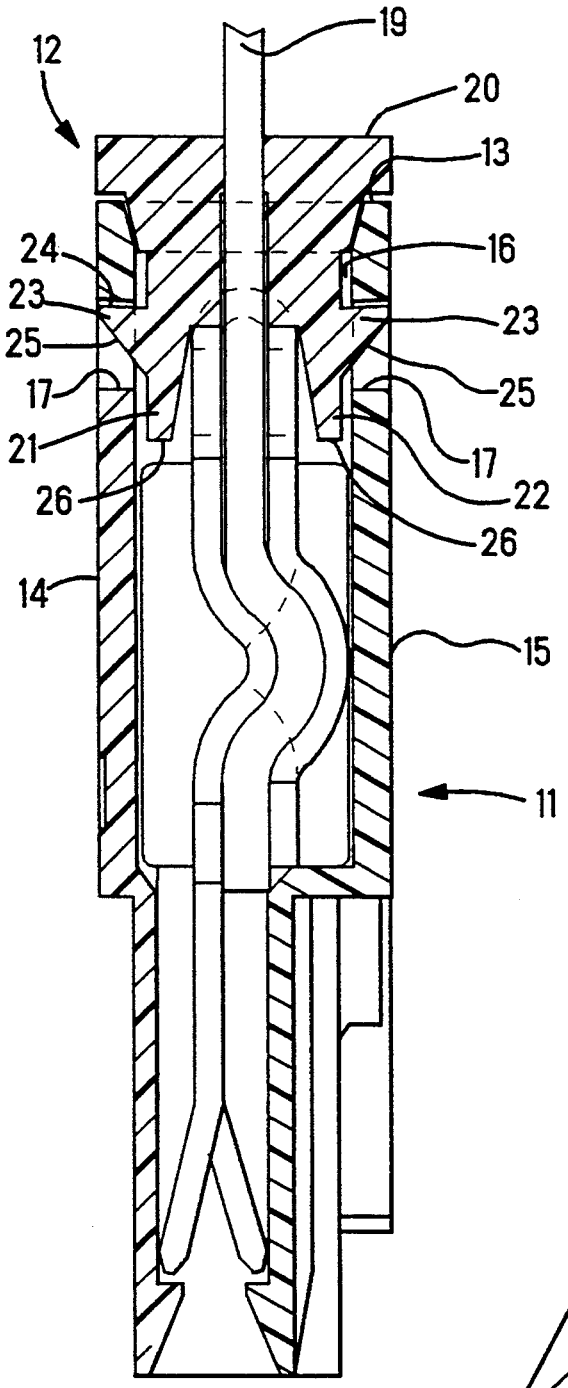
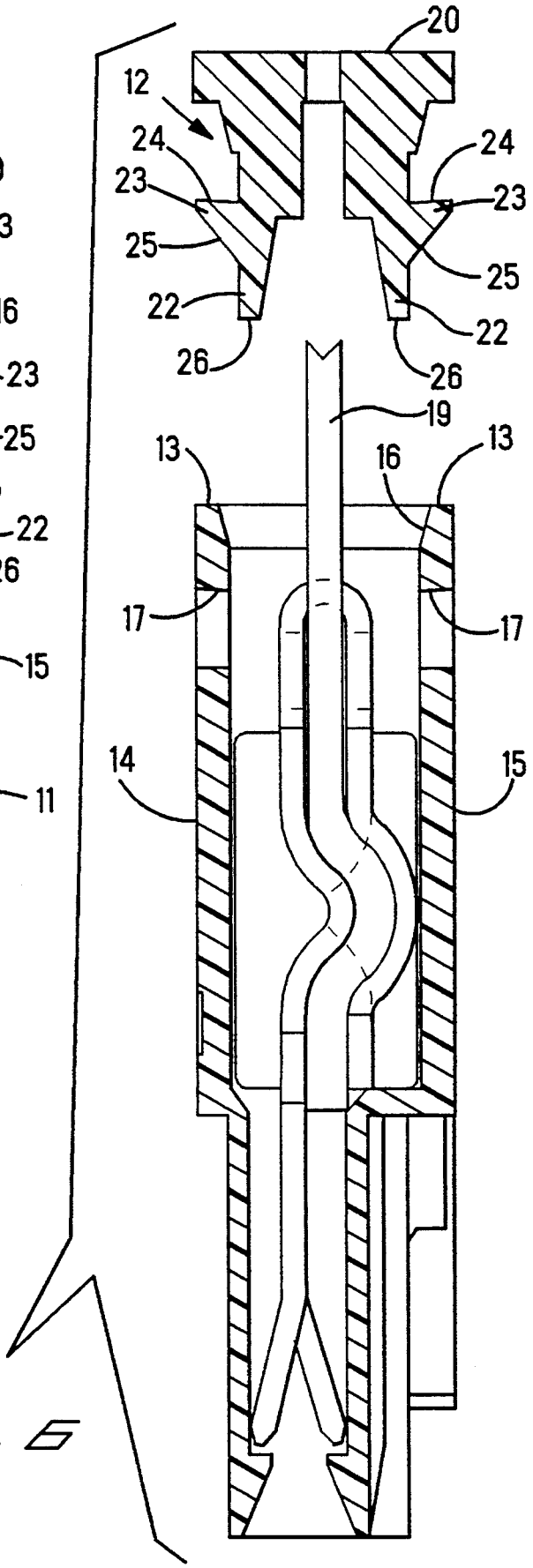
Fig. 6

PROTECTIVE COVER FOR HEADER

This application is a continuation of application Ser. No. 08/083,407 filed Jun. 25,1993, now abandoned.

FIELD OF THE INVENTION

The present invention relates to a protective rear cover for a connector in an electrical circuit, and, more particularly, to a protective rear cover for use with high voltage which prevents arcing through latch apertures in the connector.

BACKGROUND OF THE INVENTION

In electrical equipment, circuits are frequently connected by flat cable which is terminated to at least one terminal within a connector, such as a header, as in U.S. Pat. No. 4,921,442. This patent further discloses the use of a protective rear cover that is secured to the housing to prevent the terminals within the connector housing from being opened when torque is applied to the cable. The header has latch apertures which receive latches from the rear cover. The latch apertures are larger than the latches in order to more easily receive the latches resulting in spaces between the latches and the edges of the latch apertures. In many cable connectors, the latch apertures are uncovered and are open to the electrical equipment. In those circuits in which high voltage (600 V or greater) is present, arcing frequently occurs between metal parts outside the header and the electrical terminals within the header. The arcing passes through spaces exposed around the latches in the apertures and interferes with the operation of the equipment, sometimes damaging the circuitry.

SUMMARY OF THE INVENTION

It is an object of the present invention to provide a protective rear cover for a cable connector which can be used with high voltages and which prevents arcing.

It is a further object to provide a connection that prevents arcing, is cost effective to manufacture and is easy to use.

In accordance with the teachings of the present invention, there is disclosed herein a cable connector for use with high voltage comprising a housing and a protective rear cover. The housing has a cable receiving face, a mating face, opposed first and second sidewalls and opposed end walls, the walls defining a cable receiving cavity. Each sidewall has at least two spaced-apart latch apertures formed therein near the cable receiving face of the housing. The protective rear cover has a rear face having first and second side walls extending forwardly from opposite sides thereof. The sidewalls of the cover are received in the cable receiving cavity of the housing. Each sidewall of the cover has at least two spaced-apart latching projections or fingers formed thereon. In latching the cover to the housing, the latching projections on the first sidewall of the cover are received in the apertures on the first sidewall of the housing, and the latching projections on the second sidewall of the cover are received in the apertures on the second sidewall of the housing. In this manner, the cover is secured to the housing. Means are provided for covering any spaces of the housing wall apertures not filled by the latching projections to prevent arcing through the apertures in the presence of high voltage.

Preferably, the first and second sidewalls of the protective rear cover have portions that project forwardly and sidewardly beyond the latching projections. When the latching projections on the respective sidewall portions are received in the respective apertures in the housing, the respective first and second sidewalls are adjacent to the apertures in the housing and completely cover any open spaces between the latch fingers or projections and the edges of the latch receiving apertures to prevent arcing through the apertures.

Alternately, the cable connector has a sleeve-like member which has four sidewalls and an opening therebetween. The sleeve-like member is disposed over the cable receiving end of the housing such that the housing is received in the opening in the sleeve-like member. In this manner, the sleeve-like member covers the latch apertures on the sides of the housing to prevent arcing through the apertures.

These and other objects of the present invention will become apparent from a reading of the following specification, taken in conjunction with the enclosed drawings.

BRIEF DESCRIPTION OF THE DRAWINGS

FIG. 5 is a cross-sectional view taken across the lines 5—5 of FIG. 2.

FIG. 6 is a cross-sectional view taken across the lines 6—6 of FIG. 1.

DETAILED DESCRIPTION OF THE PREFERRED EMBODIMENTS

Figure 1:
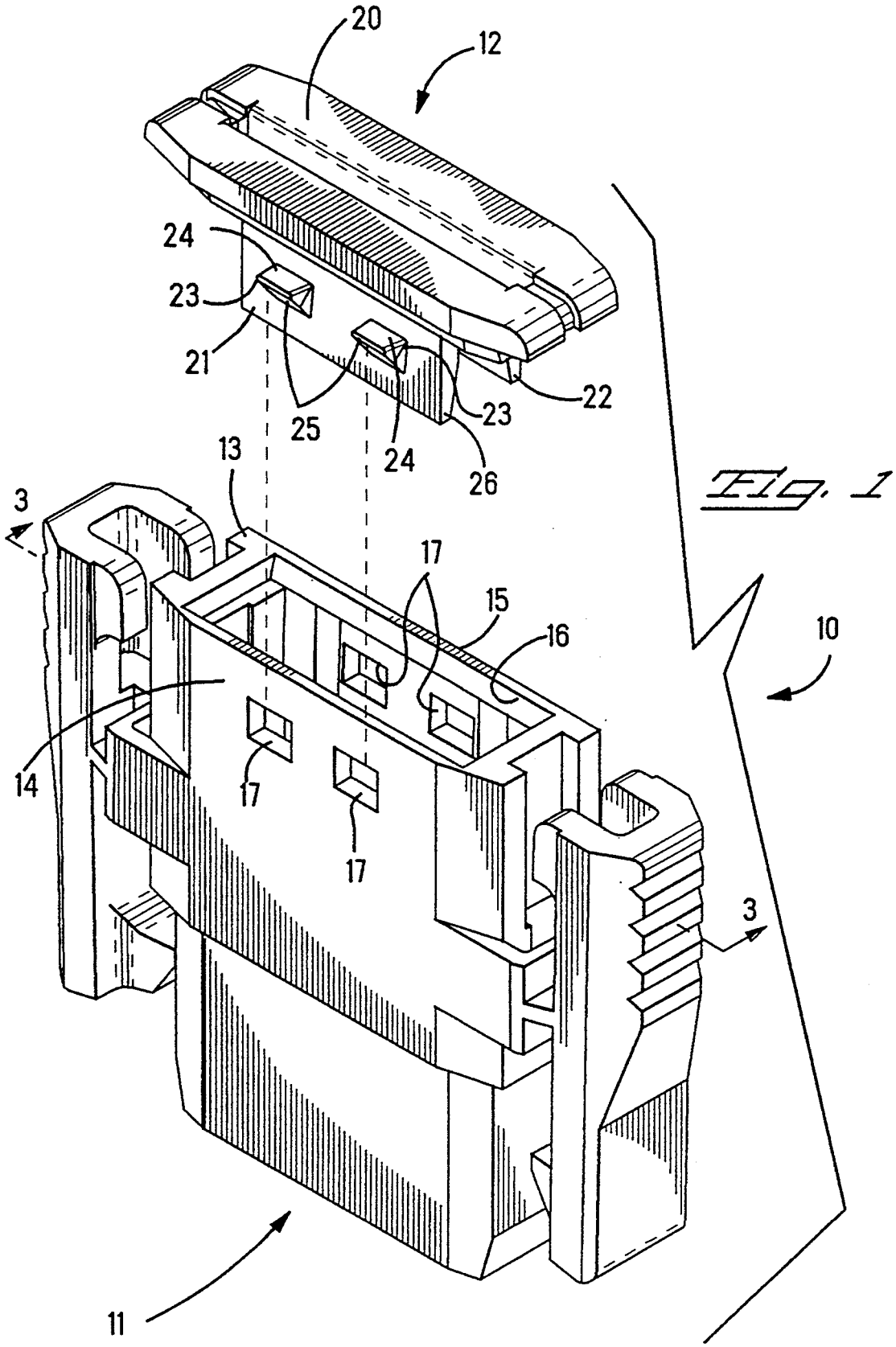
FIG. 1 is an exploded perspective of the cable connector of the present invention showing the protective rear cover separated from the header.

Referring now to FIGS. 1–6, a cable connector 10 for use with high voltage of approximately 600 V and greater includes a housing 11 and a protective rear cover 12.

The housing 11 has a cable receiving face 13, a mating face 18, opposed first and second sidewalls 14, 15, and opposed end walls, the walls defining a cable receiving cavity 16. Each sidewall 14, 15 has at least two spaced-apart latch apertures 17 formed thereon near the cable receiving face 13 of the housing 11.

Figure 2:
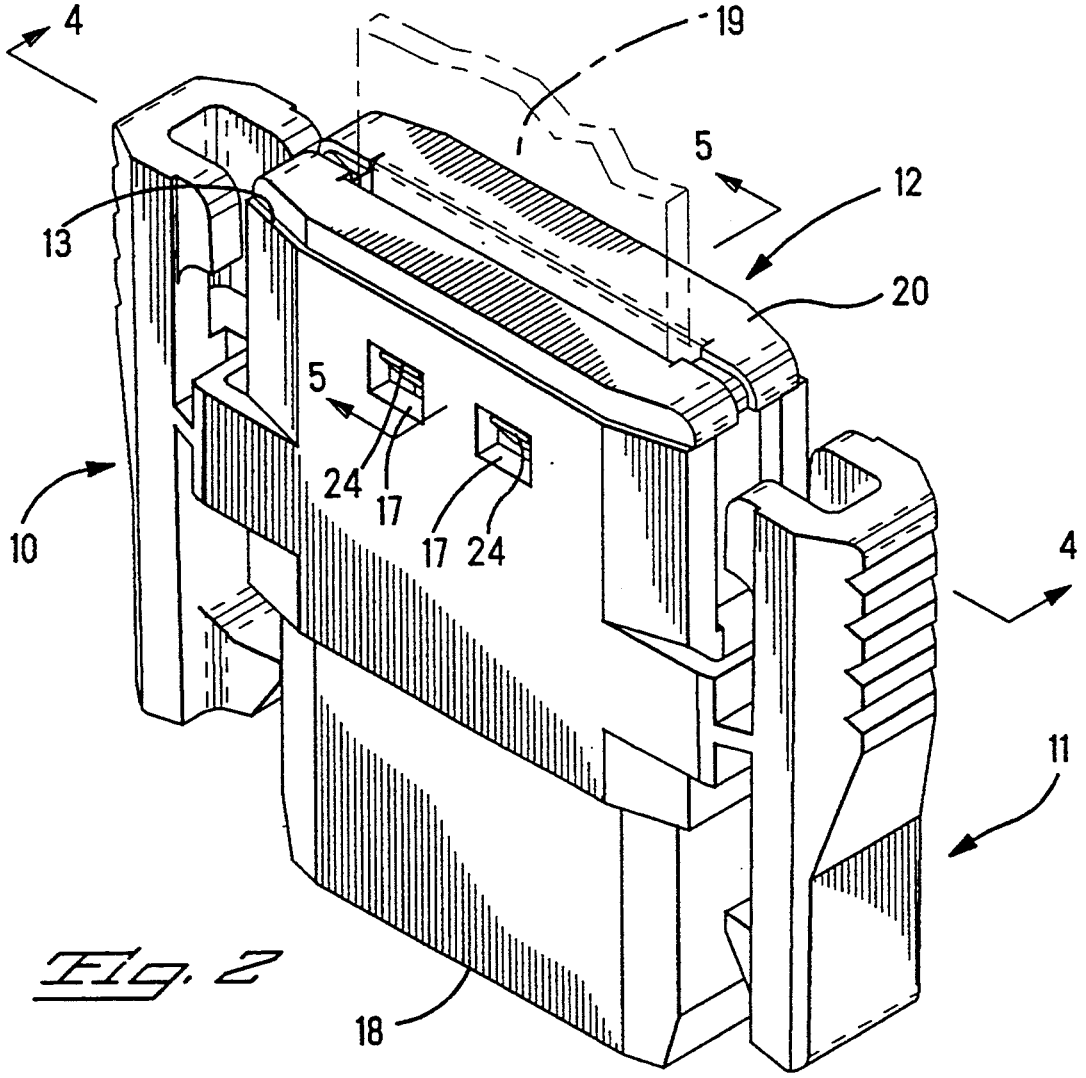
FIG. 2 is a perspective view of the cable connector of the present invention showing the protective rear cover connected to the header.
Figure 7:
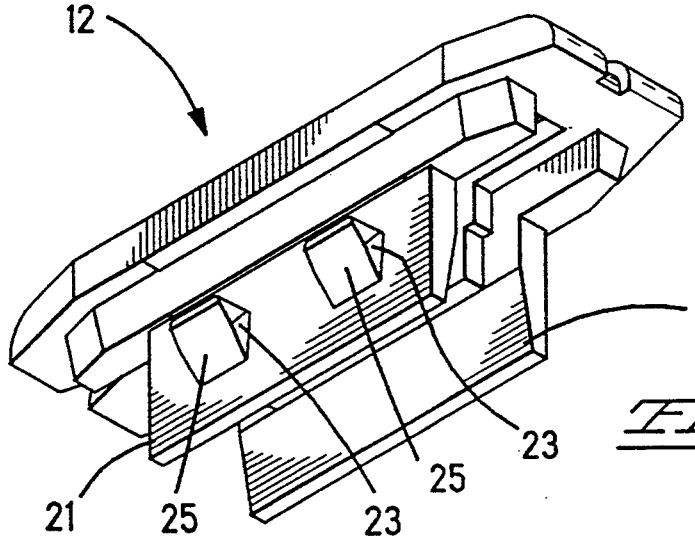
FIG. 7 is a perspective view of the protective rear cover showing the bottom of the cover and the two projecting sidewall portions.
Figure 3:
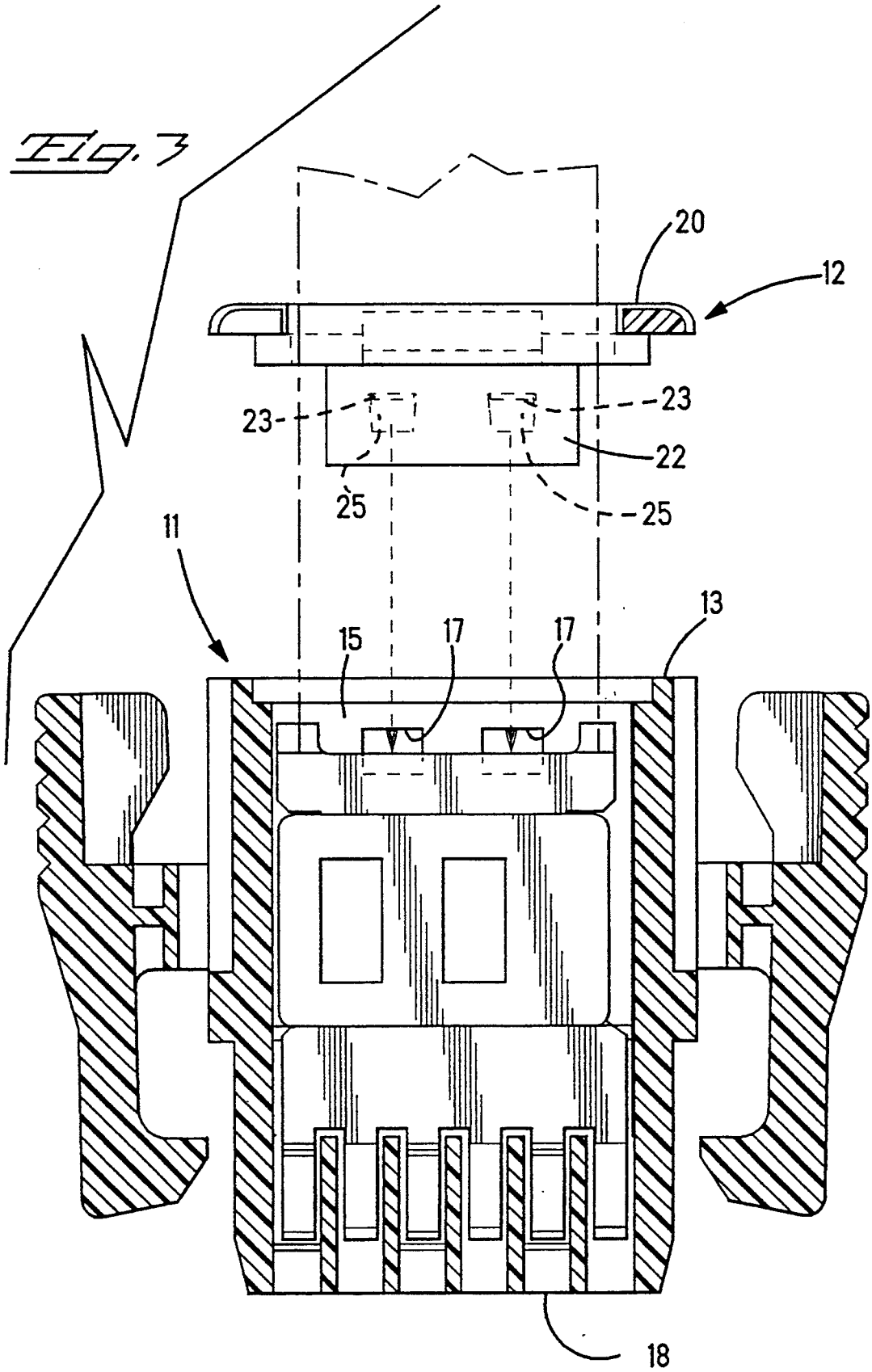
FIG. 3 is a cross-sectional view taken across the lines 3—3 of FIG. 1.
Figure 4:
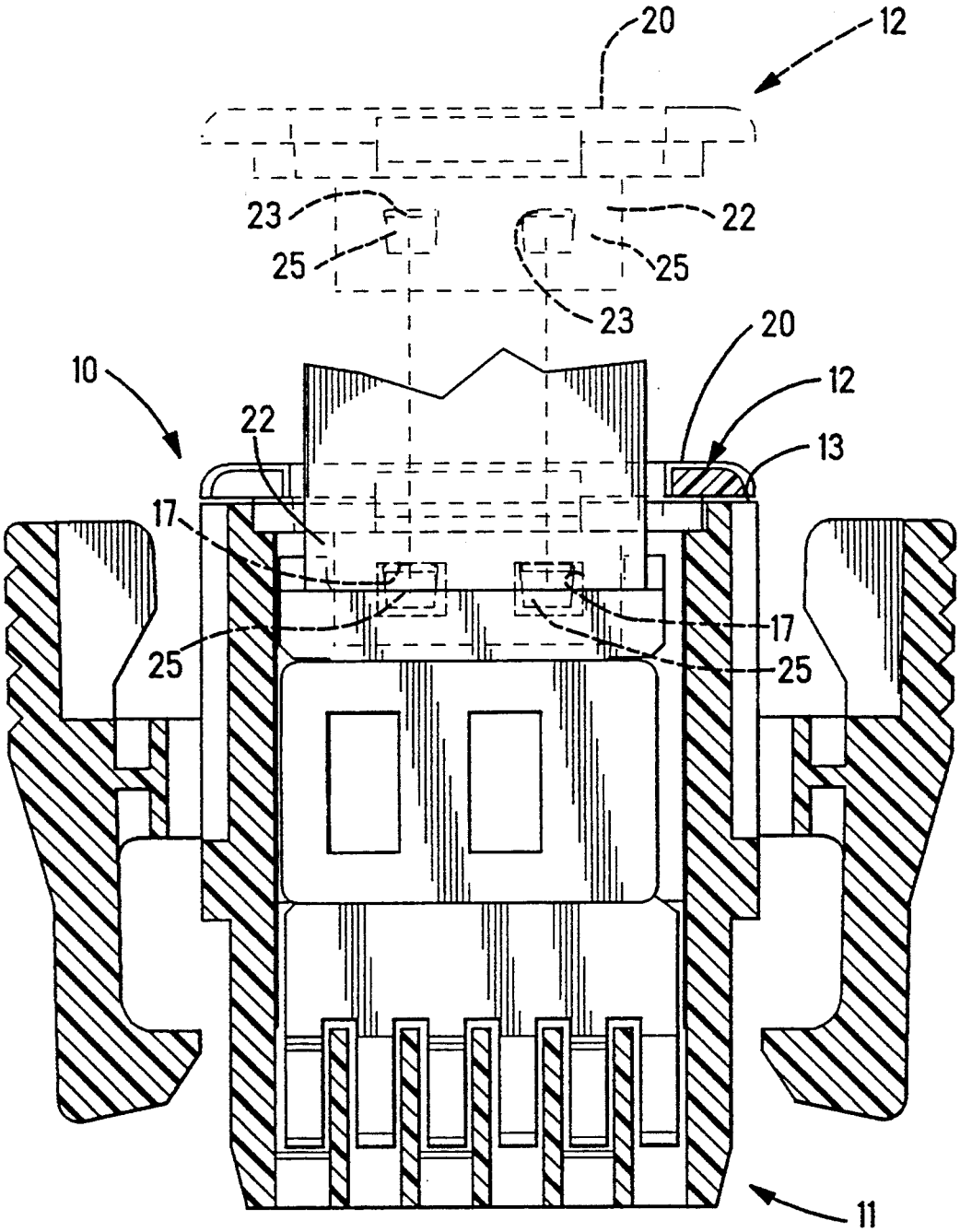
FIG. 4 is a cross-sectional view taken across the lines 4—4 of FIG. 2.

The protective rear cover 12 has a rear face 20, and opposed first and second arms or sidewalls 21, 22 extending forwardly from the rear face 20. Forwardly of cable-engaging surfaces adjacent rear face 20, sidewalls 21, 22 are spaced apart from side to side slightly larger than the thickness of the cable (see FIGS. 5 and 6) to facilitate translation along the cable after the cable has been inserted into housing 11, for the cover to be secured to the housing. The sidewalls 21, 22 are adapted to be received in the cable receiving cavity 16 of housing 11 adjacent housing sidewalls 14, 15 respectively. FIGS. 2 and 3 show, in phantom, a flat cable 19 terminated to an electrical terminal in housing 11, with a fragmentary portion of the cable extending from the rear face 20 of the protective rear cover 12. As seen in FIG. 3, cover 12 is split at one end thereof so that the cover 12 can be slipped over cable 19 after the terminal and cable terminated thereto have been inserted into the housing 11. Details of the housing structure, electrical terminal and the assembly process are more fully discussed in U.S. Pat. No. 4,921,442, which is herein incorporated by reference. At least two spaced-apart latching fingers 23 are formed on each of the sidewalls 21, 22 of the rear cover 12. Preferably, each latching finger 23 is in the shape of a right triangle with the leg of the triangle connected to the respective sidewall 21, 22 and the base 24 of each triangle extending outwardly and perpendicularly from the respective sidewall 21, 22. The base 24 of each triangle is substantially parallel to the rear face 20 of the protective rear cover 12. The hypotenuse 25 of the triangle is angled from the base 25 toward the bottom edge 26 of the respective sidewall 21, 22 as seen in FIGS. 1 and 3–7. In this manner, when the protective rear cover 12 is inserted into the cable receiving cavity 16 in the cable receiving face 13 of the housing 11, the respective hypotenuse 26 of each triangular latching finger 23 guides the respective latching finger 23 into the respective latch apertures 17 on both sidewalls 14, 15 of the housing 11. Each entire triangular latching projection 23 is received in the respective latch aperture 17 and the base 24 of each respective latching projection 23 is securely retained in the respective latch aperture 17 so that the protective rear cover 12 is not easily removed from the housing 11. Preferably, the first and second sidewalls 21, 22 of the protective rear cover 12 have flangs or portions that project forwardly and sidewardly beyond the latching fingers or projections 23. When the latching projections 23 on the respective sidewall portions 21, 22 are received in the respective apertures 17 in the housing 11, the respective first and second cover sidewalls 21, 22 are adjacent to the apertures 17 in the respective housing sidewalls 14, 15 and completely cover any open spaces between the latching projections 23 and the edges of the latch apertures 17 to prevent arcing through the apertures 17, as shown in FIGS. 3–6. In this manner, arcing through the latch apertures 17 is prevented.

Figure 8:
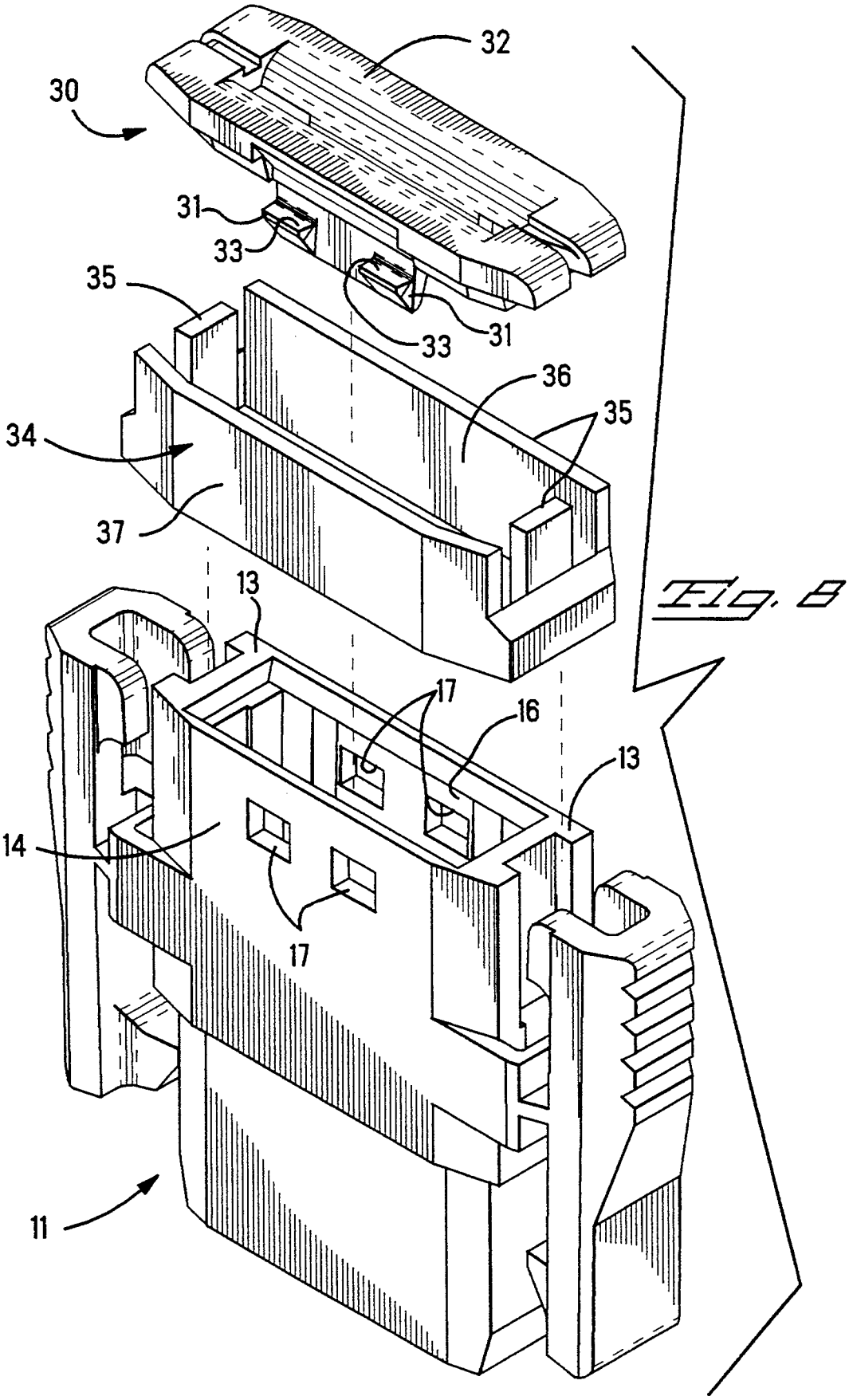
FIG. 8 is an exploded perspective view of an alternate embodiment of the present invention showing the protective rear cover, the sleeve and the connector.
Figure 9:
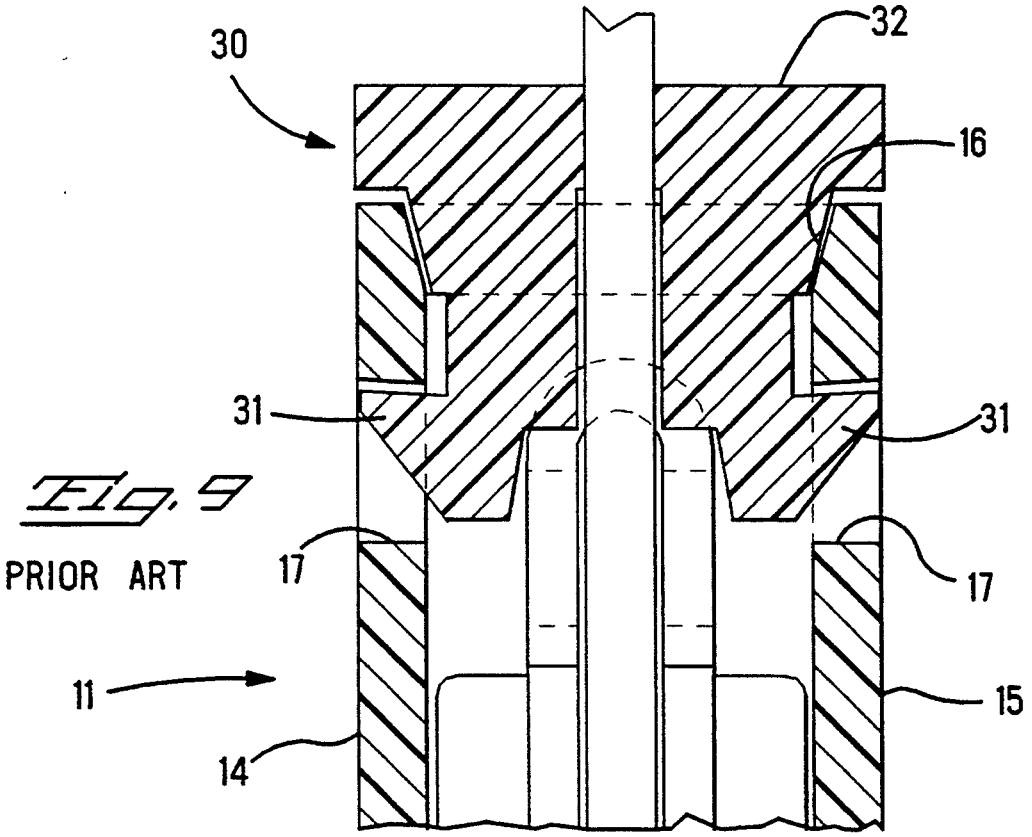
Fig. 9 PRIOR ART
FIG. 9 is a cross-sectional view of the prior art showing the latches in the latch apertures.
Figure 10:
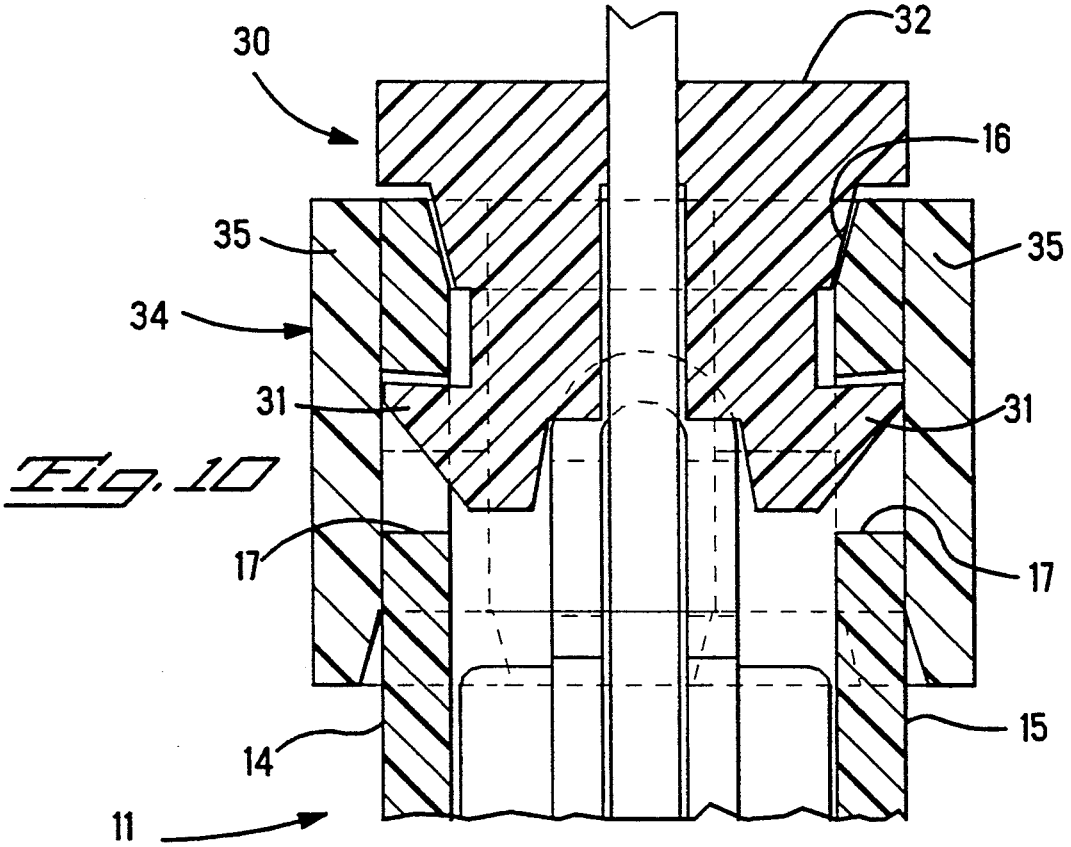
FIG. 10 is a cross-sectional view of the embodiment of FIG. 8 showing the sleeve covering the latch apertures.

In an alternate embodiment 110 (FIGS. 8 and 10), the housing 11 is unchanged from the embodiment described above and is similar to the housing used in the industry. The protective rear cover 30 is also similar to the type used in the industry and is shown in prior art FIG. 9. At least a pair of spaced-apart latching fingers or projections 31 are formed on each side of the protective rear cover 30. The respective arms including latching projections 31 extend downwardly from the rear face 32 of the cover 30, and latching projections 31 are disposed along the forward and side edges thereof. The cover arms do not have flange portions that extend forwardly or sidewardly from the latching projections 31, as described in the previous embodiment. The latching projections 31 each have a latching surface 33 to engage the latch apertures 17 in the respective sidewalls 14, 15 of the housing 11. A sleeve-like member 34 has four sidewalls 35 which define an opening 36 therebetween. The sleeve-like member 34 is disposed over the cable receiving face 13 of the housing 11 so that the cable receiving end of the housing 11 is received in the opening 36 in the sleeve-like member 34. When so mounted, the sleeve-like member 34 has a length which extends downwardly over the latch apertures 17 on both sidewalls 14, 15 of the housing 11. The protective rear cover 30 is inserted in the opening 16 in the cable receiving face 13 of the housing 11 and the latching fingers 31 are secured in the latch apertures 17 in the housing 11. In this manner, the protective rear cover 30 further serves to hold the sleeve-like member 34 in place covering the latch apertures 17. Comparing the prior art (FIG. 9) with the alternate embodiment (FIG. 10), it can be seen that the sleeve-like member 34 effectively covers the latch apertures 17 to prevent arcing.

Figure 11:
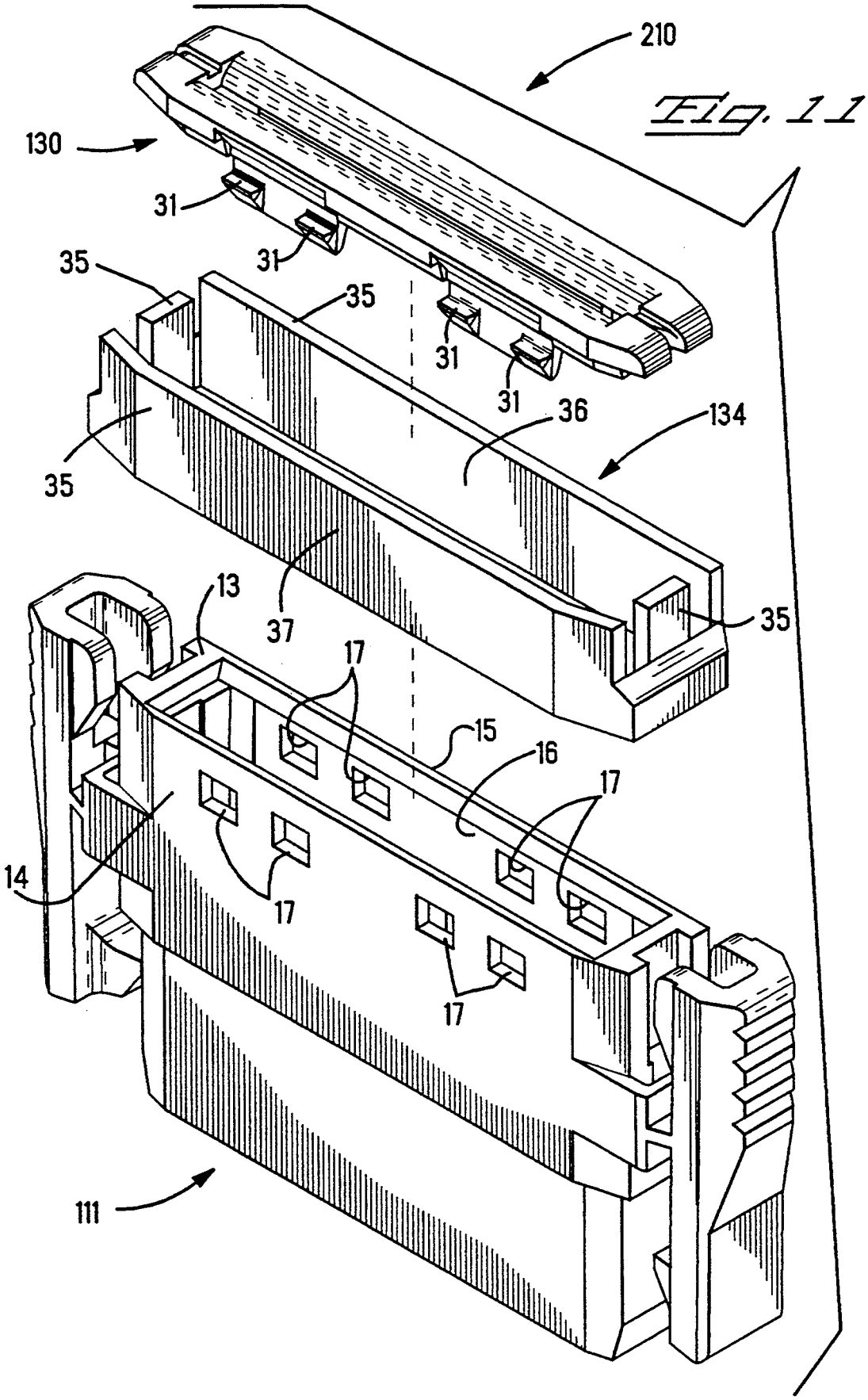
FIG. 11 is an exploded perspective view of the embodiment of FIG. 8 showing a double cable connector.

If desired, a double cable connector 210 may be provided as shown in FIG. 11. Two sets of latching fingers 31 are formed on a pair of arms on each side of the protective rear cover 130 and corresponding pairs of latch apertures 17 are formed on each sidewall 14, 15 of the housing 111. The double connector may be used in conjunction with a sleeve member 134, as shown in FIG. 11 or alternatively the rear cover may be made with sidewall extensions as previously described. The double connector accommodates wider or multiple cables, all terminated within a single housing.

If desired, indicia such as "HIGH VOLTAGE" or other marking as desired, may be affixed at 37 to one or more of the longer sidewalls 35 of the sleeve-like member 34 to warn users of a potential danger. The warning marking at 37 may be of a distinctive color if desired.

The cable connector of the present invention, in either embodiment, is a component which can be molded or formed cost effectively and is easily operated or assembled by simple instructions without requiring training or special tooling.

It is thought that the protective cover of the present invention and many of its attendant advantages will be understood from the foregoing description. It is apparent that various changes may be made in the form, construction, and arrangement of parts thereof without departing from the spirit or scope of the invention, or sacrificing all of its material advantages.

What is claimed is:

1. An improved cable connector for use with high voltage flat wide cable including a dielectric housing and a dielectric protective rear cover, the housing having a cable receiving face, a first wide sidewall and an opposite second wide sidewall joined by end walls, an opening being formed between said sidewalls and endwalls; the protective rear cover being a one-piece member having a pair of transverse cable engagement sections associated with said sidewalls and with the wide major surfaces of the cable, the cover being securable to said housing to extend across the cable receiving face thereof adjacent rearward exposed ends of terminal members within said housing, each transverse cable engagement section having at least two spaced-apart latching projections disposed forwardly thereof on respective arms with the arms spaced apart from side to side not less than the nominal thickness of the cable, in order that said cover is securable to the rearward end of the connector after the cable is secured therein and each of said projections may be secured in respective corresponding latch apertures in each of the first and second housing sidewalls, the latching projections and apertures being adjacent the exposed rearward terminal ends, the improvement comprising:

flanges extending laterally from said arms for covering said apertures in the housing to prevent arcing through said apertures in the presence of high voltage when said protective rear cover is secured to said housing and said latching projections are secured in said housing apertures.

2. The cable connector of claim 1 wherein the dielectric protective rear cover further comprises a first sidewall portion depending from one of said pair of transverse cable engagement sections of the cover and a second sidewall portion depending from the other of said pair of transverse cable engagement sections of the cover, both defining the arms and flanges associated with the pair of latching projections with the respective latching projections being disposed on the respective first and second sidewall portions, wherein, when the latching projections on the respective sidewall portions of the cover are received in the respective apertures in the housing, the respective first and second sidewall portions are adjacent to said apertures in the housing and completely cover said latch apertures to prevent arcing through said apertures.

3. The cable connector of claim 1 further comprising a dielectric sleeve-like member having four sidewalls and an opening therebetween, the sleeve-like member being disposed over the cable receiving face of the housing such that the housing is received in the opening in the sleeve-like member, the sleeve-like member covering the latch apertures on the sidewalls of the housing to prevent arcing through said apertures.

4. The cable connector of claim 3, wherein the sleeve-like member has markings thereon to warn of high voltage.

5. The cable connector of claim 1 wherein each sidewall portion has a bottom edge, each latching projection is substantially a right triangle having a base and a hypotenuse, the base of the triangle extending outwardly from the respective side of the cover, the hypotenuse of the triangle being angled from the base of the triangle toward the bottom edge of the respective side, wherein when the latching projections are received in the latch apertures, the hypotenuses of the respective triangles guide the latching projections into said latch apertures and the respective bases of the triangles secure the latching projections in the respective latch apertures.

* * * * *